US010370912B2

(12) United States Patent
Tavakoli et al.

(10) Patent No.: US 10,370,912 B2
(45) Date of Patent: Aug. 6, 2019

(54) THREADED CONNECTION MANAGEMENT SYSTEM AND METHOD

(71) Applicant: NABORS DRILLING TECHNOLOGIES USA, INC., Houston, TX (US)

(72) Inventors: Farzan Tavakoli, Calgary (CA); Hendrik Schalk Le Roux, Lafayette, LA (US); Colin Trevor Maxwell, Calgary (CA); Vince Fortier, Dubai (AE)

(73) Assignee: Nabors Drilling Technologies USA, Inc., Houston, TX (US)

( * ) Notice: Subject to any disclaimer, the term of this patent is extended or adjusted under 35 U.S.C. 154(b) by 69 days.

(21) Appl. No.: 15/499,680

(22) Filed: Apr. 27, 2017

(65) Prior Publication Data

US 2017/0314344 A1 Nov. 2, 2017

Related U.S. Application Data

(60) Provisional application No. 62/329,941, filed on Apr. 29, 2016.

(51) Int. Cl.

| | |
|---|---|
| ***E21B 19/16*** | (2006.01) |
| ***E21B 19/06*** | (2006.01) |
| ***E21B 3/04*** | (2006.01) |
| ***E21B 17/042*** | (2006.01) |

(52) U.S. Cl.

CPC ..... *E21B 19/06* (2013.01); *E21B 3/04* (2013.01); *E21B 17/042* (2013.01); *E21B 19/16* (2013.01); *E21B 19/161* (2013.01)

(58) Field of Classification Search

CPC ..... E21B 3/04
USPC ..... 166/380
See application file for complete search history.

(56) References Cited

U.S. PATENT DOCUMENTS

| | | | | |
|---|---|---|---|---|
| 2,075,426 | A * | 3/1937 | Church | E21B 19/10 166/85.1 |
| 4,352,399 | A | 10/1982 | Davis | |
| 4,495,840 | A | 6/1985 | Freitag et al. | |
| 6,311,789 | B1 | 11/2001 | Saxman | |
| 2012/0234601 | A1 | 9/2012 | Griffin | |
| 2015/0315859 | A1 | 11/2015 | Strydom | |

OTHER PUBLICATIONS

PCT/US2017/030142 International Search Report and Written Opinion dated Sep. 21, 2017.

* cited by examiner

*Primary Examiner* — Taras P Bemko
(74) *Attorney, Agent, or Firm* — Enrique Abarca; Abel Schillinger, LLP

(57) ABSTRACT

Present embodiments are directed a mineral extraction system comprising a locking clamp configured to be secured to a first tubular member, wherein the locking clamp comprises an outer radial surface having a first geometry and a rotary table adapter. The rotary table adapter comprises a base and an extension extending from the base, wherein the extension defines a recess, the recess comprises an inner radial surface having a second geometry, wherein the first geometry and the second geometry correspond with one another, and the rotary table adapter is configured to be disposed within a rotary table of a drilling rig.

18 Claims, 4 Drawing Sheets

THREADED CONNECTION MANAGEMENT SYSTEM AND METHOD

CROSS REFERENCE TO RELATED APPLICATION

This application is a Non-Provisional Application claiming priority to U.S. Provisional Application No. 62/329,941, entitled "THREADED CONNECTION MANAGEMENT SYSTEM AND METHOD," filed Apr. 29, 2016, which is hereby incorporated by reference in its entirety for all purposes.

BACKGROUND

Present embodiments relate generally to the field of drilling and processing of wells, and, more particularly, to a system and method to facilitate coupling and/or decoupling of threaded connections between mineral extraction system components, such as mandrels, actuators, drillpipe elements, tubular elements, and the like.

In conventional oil and gas operations, a well is typically drilled to a desired depth with a drill string, which includes drill pipe and a drilling bottom hole assembly (BHA). Once the desired depth is reached, the drill string is removed from the hole and casing is run into the vacant hole. In some conventional operations, the casing may be installed as part of the drilling process. A technique that involves running casing at the same time the well is being drilled may be referred to as "casing-while-drilling."

Casing may be defined as pipe or tubular that is placed in a well to prevent the well from caving in, to contain fluids, and to assist with efficient extraction of product. When the casing is run into the well, the casing may be externally or internally gripped by a grappling system installed under a top drive. Specifically, the grappling system may exert an external pressure or force or an internal pressure or force on the casing to prevent the casing from sliding off the grappling system. With the grappling system engaged with the casing, the weight of the casing is transferred to the top drive that hoists and supports the casing for positioning down hole in the well. As will be appreciated, the grappling system may have one or more differently sized components for lifting casing of different sizes (e.g., diameters).

When the casing is properly positioned within a hole or well, the casing is typically cemented in place by pumping cement through the casing and into an annulus formed between the casing and the hole (e.g., a wellbore or parent casing). Once a casing string has been positioned and cemented in place or installed, the process may be repeated via the now installed casing string. For example, the well may be drilled further by passing a drilling BHA through the installed casing string and drilling. Further, additional casing strings may be subsequently passed through the installed casing string (during or after drilling) for installation. Indeed, numerous levels of casing may be employed in a well. For example, once a first string of casing is in place, the well may be drilled further and another string of casing (an inner string of casing) with an outside diameter that is accommodated by the inside diameter of the previously installed casing may be run through the existing casing. Additional strings of casing may be added in this manner such that numerous concentric strings of casing are positioned in the well, and such that each inner string of casing extends deeper than the previously installed casing or parent casing string.

BRIEF DESCRIPTION

In accordance with one aspect of the disclosure, a mineral extraction system including a locking clamp configured to be secured to a first tubular member, wherein the locking clamp comprises an outer radial surface having a first geometry and a rotary table adapter. The rotary table adapter includes a base and an extension extending from the base, wherein the extension defines a recess, the recess comprises an inner radial surface having a second geometry, wherein the first geometry and the second geometry correspond with one another, and the rotary table adapter is configured to be disposed within a rotary table of a drilling rig.

In accordance with another aspect of the disclosure, a method includes coupling a locking clamp to a first tubular of a drilling system, wherein the locking clamp and the first tubular are rotationally fixed relative to one another, positioning the locking clamp within a locking clamp recess defined by an extension of a rotary table adapter, wherein the recess comprises a first geometry corresponding to a second geometry of the locking clamp, disposing the rotary table adapter within a rotary table adapter recess formed in a drilling rig floor, and rotating a second tubular relative to the first tubular to thread or unthread the first tubular to or from the second tubular.

In accordance with a further embodiment of the disclosure, a drilling system includes a first tubular, a second tubular configured to threadingly engage with the first tubular, a locking clamp secured to the first tubular, wherein the locking clamp comprises an outer radial surface having a first geometry, a rotary table adapter comprising a locking clamp recess, wherein the locking clamp recess comprises an inner radial surface having a second geometry, and the rotary table adapter defines a third geometry, and a drilling rig floor comprising a rotary table adapter recess defining a fourth geometry, wherein the first geometry and the second geometry correspond with one another, and the third geometry and the fourth geometry correspond with one another.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
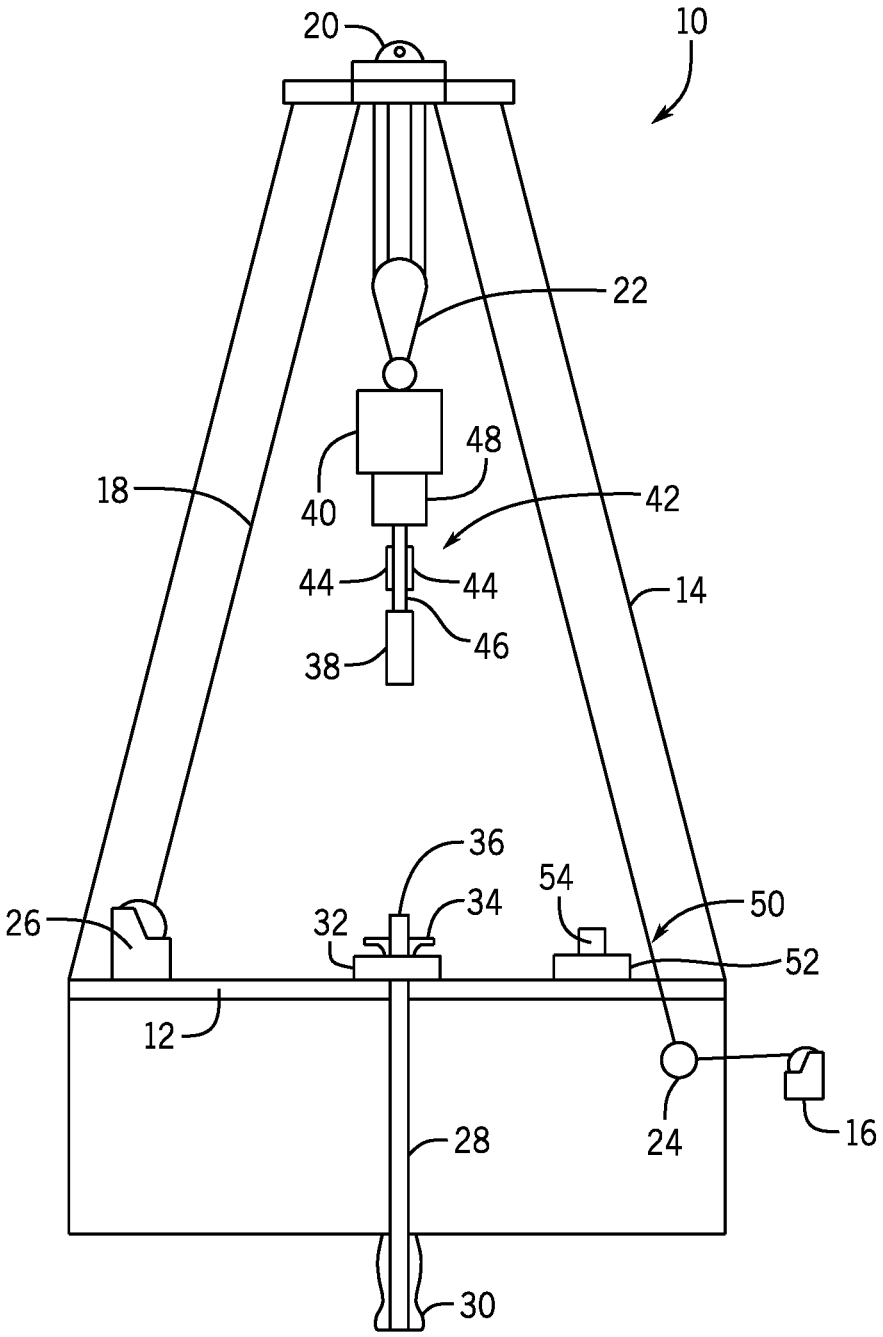
FIG. 1 is a schematic of a well being drilled, in accordance with an embodiment of the present disclosure.

Embodiments of the present disclosure are directed to a threaded connection breakout system for enabling coupling and decoupling of threaded connections between two tubular components of a mineral extraction system. For example, the disclosed threaded connection breakout systems may be used to create or "make up" and disconnect or "break" a threaded connection between a mandrel of a tubular grappling system and an actuator of a tubular grappling system. Tubular grappling systems include internal tubular grappling systems, which grip a tubular by applying an internal pressure or force on an internal surface of the tubular. A contact surface of the grappling system (e.g., grapple) engages (e.g., "bites") with the tubular to grip the tubular. The contact surfaces of the tubular grappling system may be driven outward to engage with the internal surface of the tubular by a mandrel that is actuated by an actuator of the tubular grappling system. In certain embodiments, the mandrel and the actuator of the tubular grappling system are connected to one another via a threaded connection.

Gripping different sizes of tubular may require differently sized components of the tubular grappling system. For example, a tubular grappling system may use mandrels of different sizes to grip tubulars of different sizes (e.g., different diameters). However, the tubular grappling system may use the same actuator to grip all sizes of tubular. In other words, a universal actuator may be used with mandrels of different sizes to grip tubulars of different sizes (e.g., diameters). Thus, if an operator wishes to grip different sizes of tubular, the mandrel of the tubular grappling system may be disconnected (e.g., unthreaded) from the actuator of the tubular grappling system, and another mandrel of a different size may be threaded to the actuator. Unfortunately, unthreading a mandrel from an actuator traditionally involves the rigging out (e.g., uninstallation) of the tubular grappling system and disassembly of the mandrel from the actuator at a location remote from a drilling location (e.g., a machine shop). As will be appreciated, this procedure costs money and takes time. Accordingly, present embodiments include the threaded connection breakout system for enabling connection and disconnection (e.g., threading and unthreading) of a mandrel to and from an actuator of a tubular grappling system on a drilling rig floor.

The threaded connection breakout system utilizes a rotary table on the drilling rig (or other recess in the drilling rig floor) to transmit and/or react torque and allow for breakout (or makeup) of a threaded connection (e.g., between a mandrel and actuator). As described in detail below, the threaded connection breakout system includes a rotary table adapter and a locking clamp configured to grip the mandrel to be connected or disconnected with the actuator via a threaded connection. The rotary table adapter engages with the rotary table on the drilling rig floor. When the locking clamp is in gripping engagement with the mandrel, the locking clamp is then engaged with the rotary table adapter, in the manner described below. Thereafter, torque may be applied to the mandrel (e.g., via a mechanical tong or via the top drive), the torque may be transferred to the locking clamp, and the torque will react with the rotary table adapter and the rotary table. In other words, the threaded connection breakout system may hold the mandrel in place, while the actuator may be rotated to makeup or break a threaded connection between the mandrel and the actuator.

Turning now to the drawings, FIG. 1 is a schematic of a drilling rig 10 in the process of drilling a well, in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a casing string 28 extends downward into a wellbore 30 and is held stationary with respect to the rig floor 12 by a rotary table 32 and slips 34. A portion of the casing string 28 extends above the rig floor 12, forming a stump 36 to which another length of tubular 38 (e.g., casing) may be added. In certain embodiments, the tubular 38 may include 30 foot segments of oilfield pipe having a suitable diameter (e.g., 13⅜ inches) that are joined as the casing string 28 is lowered into the wellbore 30. As will be appreciated, in other embodiments, the length and/or diameter of segments of the casing (e.g., tubular 38) may be other lengths and/or diameters. The casing string 28 is configured to isolate and/or protect the wellbore 30 from the surrounding subterranean environment. For example, the casing string 28 may isolate the interior of the wellbore 30 from fresh water, salt water, or other minerals surrounding the wellbore 30.

When a new length of tubular 38 is added to the casing string 28, a top drive 40, hoisted by the traveling block 22, positions the tubular 38 above the wellbore 30 before coupling with the casing string 28. The top drive 40 includes a tubular grappling system 42 that couples the tubular 38 to the top drive 40. In certain embodiments, the tubular grappling system 42 is inserted into (e.g., "stabbed into") the tubular 38 and then exerts a force on an internal diameter of the tubular 38 to block the tubular 38 from sliding off the grappling system 42 when the top drive 40 hoists and supports the tubular 38. In such embodiments, the tubular grappling system 42 includes contact surfaces 44 (e.g., grapples) that are driven radially outward by a mandrel 46 to enable engagement between internal surface of the tubular 38 and the contact surfaces 44. For example, the mandrel 46 may have one or more inclined surfaces, and the contact surfaces 44 may be translated down the mandrel 46 (e.g., via an actuator 48 of the tubular grappling system 42) to drive the contact surfaces 44 radially outward to engage with the internal surface of the tubular 38.

In order to grip different sizes of tubular 38 (e.g., tubulars of different diameters), the mandrel 46 of the tubular grappling system 42 may be removed and replaced with another mandrel 46 of a different size. For example, larger mandrels 46 may be used to grip larger tubulars 38, and smaller mandrels 46 may be used to grip smaller tubulars 38. To change out mandrels 46 in the tubular grappling system 42, the mandrel 46 may be unthreaded from the actuator 48 of the tubular grappling system 42, and another mandrel 46 of a different size may be threaded to the actuator 48. To enable this removal and replacement of mandrels 46 at the rig floor 12 instead of at a remote location, such as a factory or workshop, present embodiments include a threaded connection breakout system 50. In the illustrated embodiment, the threaded connection breakout system 50 is set aside on the drilling rig floor 12 and is not in use. As mentioned above, the threaded connection breakout system 50 includes a rotary table adapter 52 and a locking clamp 54. The rotary table adapter 52 engages with the rotary table 32 on the drilling rig floor 12, while the locking clamp 54 grips the mandrel 46 to be unthreaded from the actuator 48. When the locking clamp 54 is in gripping engagement with the mandrel 46, the locking clamp 54 is then engaged with the rotary table adapter 52, and the actuator 48 may be unthreaded from the mandrel 46 while the threaded connection breakout system 50 holds the mandrel 46 in place. Another mandrel 46 of a different size may be threaded to the actuator 48 using a similar reverse process. Details of the rotary table adapter 52 and the locking clamp 54 are described below.

It should be noted that the illustration of FIG. 1 is intentionally simplified to focus on threaded connection breakout system 50 described in detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
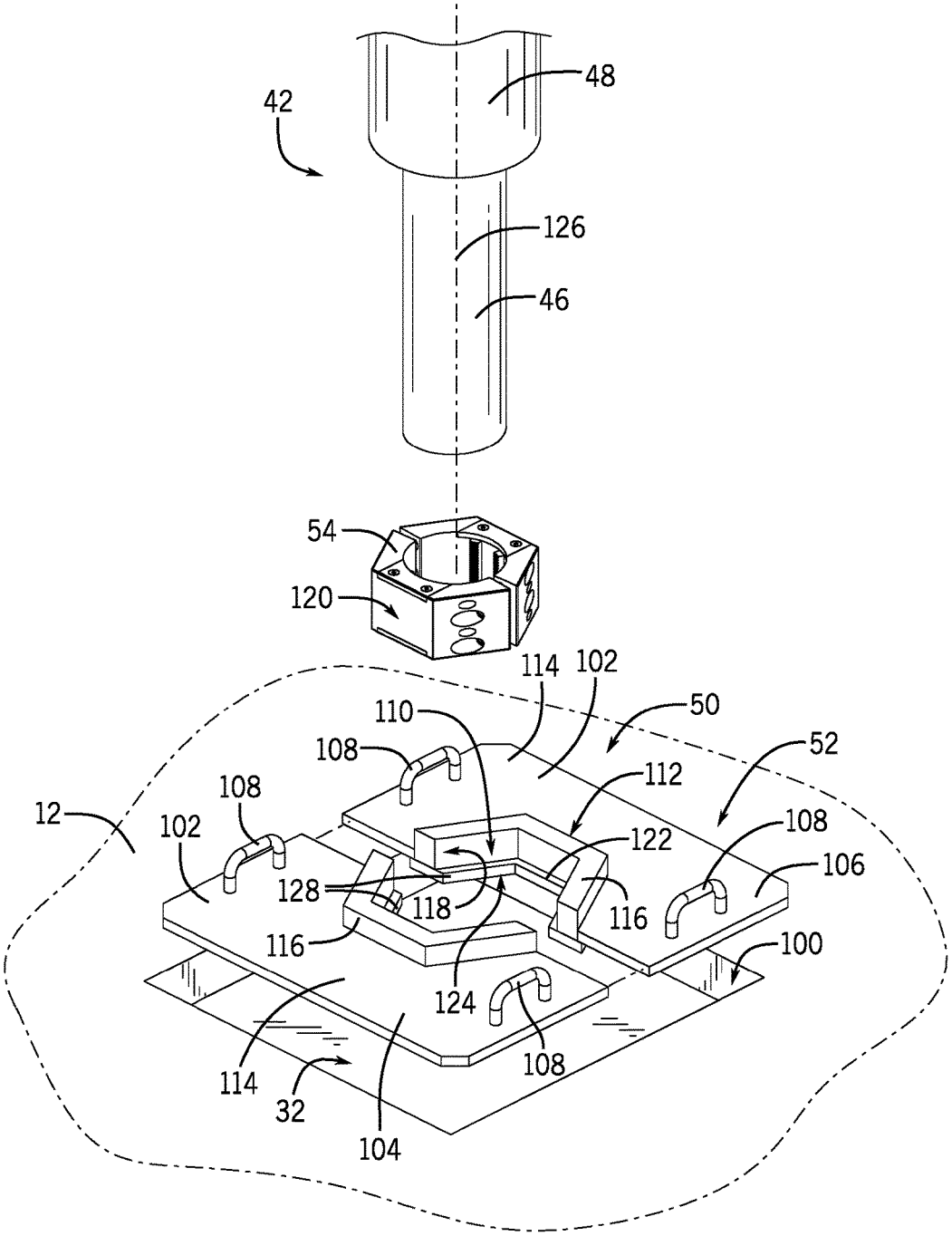
FIG. 2 is an exploded perspective view of a threaded connection breakout system, illustrating a locking clamp and a rotary table adapter of the threaded connection breakout system, in accordance with an embodiment of the present disclosure.

FIG. 2 is an exploded perspective view of the threaded connection breakout system 50, illustrating the rotary table adapter 52 and the locking clamp 54 of the threaded connection breakout system 50. As mentioned above, the rotary table adapter 52 is configured to engage with the rotary table 32 located on the drilling rig floor 12, and the locking clamp 54 is configured to grip the mandrel 46 to be threaded or unthreaded from the actuator 48 of the grappling system 42.

To engage with the rotary table 32, the rotary table adapter 52 is disposed within a recess 100 (e.g., a recess having the rotary table 32 or a rotary table recess) of the rotary table 32. To this end, the rotary table adapter 52 may have a similar geometry to the recess 100, such that movement (e.g., rotational and/or lateral movement) of the rotary table adapter 52 is restricted when the rotary table adapter 52 is disposed within the recess 100. In the illustrated embodiment, the rotary table adapter 52 includes two sections 102 (e.g., a first section 104 and a second section 106) that cooperatively form the rotary table adapter 52. However, other embodiments of the rotary table adapter 52 may include other numbers of sections 102 (e.g., 1, 3, 4, 5, or more sections 102). The sections 102 may be formed from metal (e.g., steel) or other durable material. Each section 102 also includes one or more handles 108 to enable placement of the sections 102 within the recess 100 and removal of the sections 102 from the recess 100.

The rotary table adapter 52 includes a locking clamp recess 110 formed by an extension 112 extending from a base 114 of the rotary table adapter 52. In the illustrated embodiment, each section 102 of the rotary table adapter 52 includes a portion 116 (e.g., a half portion) of the extension 112. Together the respective portion 116 of each section 102 forms the extension 112. The locking clamp recess 110 and the extension 112 have a geometry that corresponds to a geometry of the locking clamp 54. More particularly, an inner radial surface 118 of the extension 112 has a shape that corresponds to the shape of an outer radial surface 120 of the locking clamp 54. In the illustrated embodiment, the inner radial surface 118 of the extension 112 and the outer radial surface 120 of the locking clamp 54 each have a generally hexagonal shape or geometry. However, in other embodiments, the shape or geometry of the inner radial surface 118 and outer radial surface 120 may be different (e.g., square, pentagonal, octagonal, etc.). The matching or similar shapes of the locking clamp 54 and the extension 112 enable the extension 112 to block or restrict movement (e.g., rotational movement) of the locking clamp 54 when the locking clamp 54 is positioned within the locking clamp recess 110. Thus, when the locking clamp 54 is clamped and secured to the mandrel 46 and the locking clamp 54 is positioned within the locking clamp recess 110 of the rotary table adapter 52, rotation of the locking clamp 54 and the mandrel 46 is restricted. Therefore, the actuator 48 of the grappling system 42 may be rotated (e.g., via the top drive 40 or a mechanical tong) and the mandrel 46 may be held rotationally in place to enable threading and/or unthreading of the mandrel 46 to and/or from the actuator 48.

The locking clamp recess 110 also includes a shelf or shoulder 122 at an axial bottom 124 of the locking clamp recess 110. The shoulder 122 extends radially inward relative to a central axis 126 of the threaded connection breakout system 50 and the grappling system 42. In the illustrated embodiment, each section 102 of the rotary table adapter 52 includes a portion 128 (e.g., a half portion) of the shoulder 122. The shoulder 122 may support the mandrel 46 and the locking clamp 54 when unthreading of the mandrel 46 from the actuator 48 is complete and the top drive 40 and the actuator 48 are being lifted away from the rig floor 12. Additionally, when threading of the mandrel 46 to the actuator 48 is desired, the locking clamp 54 engaged with the mandrel 46 may be placed within the locking clamp recess 110 and may be supported by the shoulder 122. Thereafter, the actuator 48 may be lowered to the mandrel 46, and the actuator 48 may be rotated to thread the actuator 48 to the mandrel 46 while the mandrel 46 is held rotationally in place by the threaded connection breakout system 50.

Figure 3:
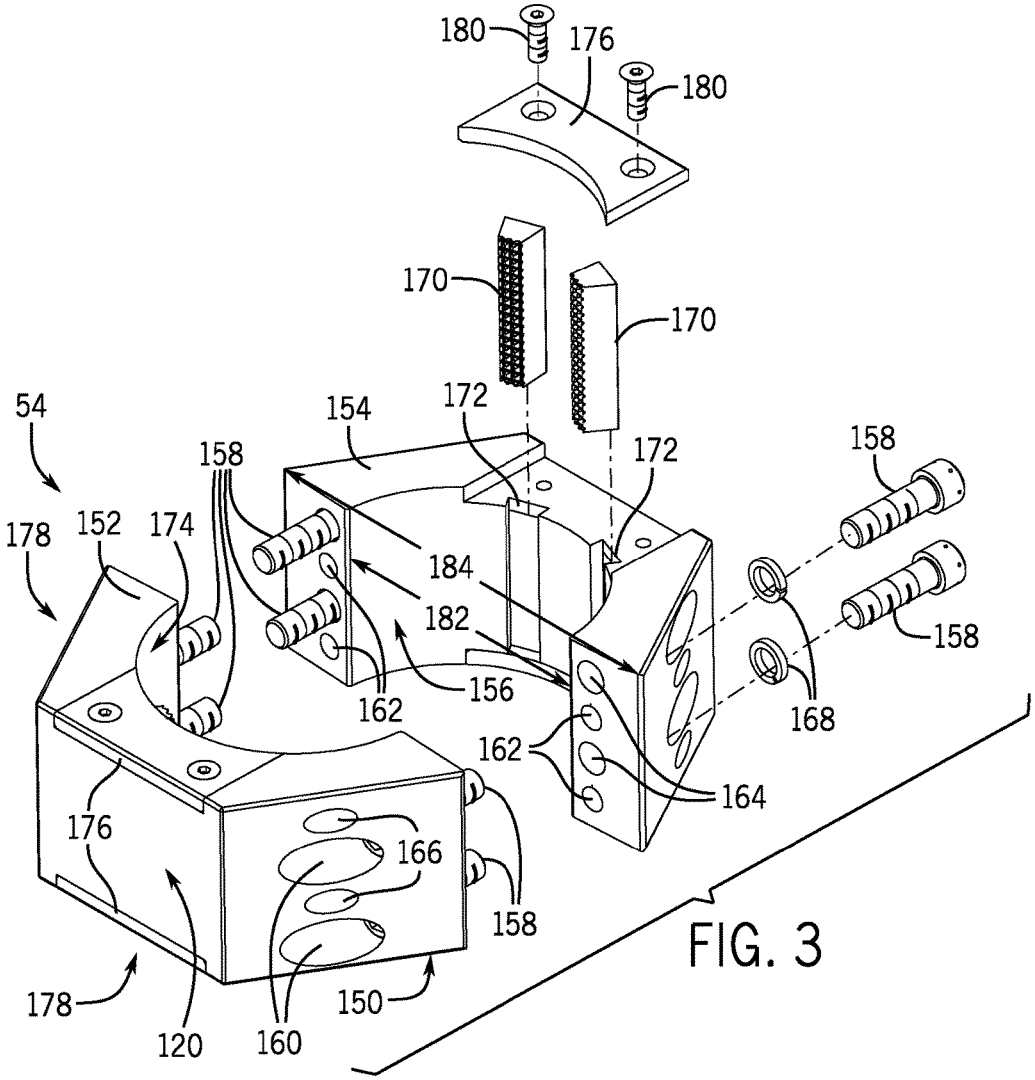
FIG. 3 is an exploded perspective view of the locking clamp of the threaded connection breakout system, in accordance with an embodiment of the present disclosure.

FIG. 3 is an exploded perspective view of the locking clamp 54 of the threaded connection breakout system 50 illustrating various components of the locking clamp 54. As mentioned above, the locking clamp 54 is configured to clamp or grip the mandrel 46, such that the mandrel 46 and the locking clamp 54 are rotationally fixed relative to one another.

The locking clamp 54 includes a clamp body 150 (e.g., generally annular body) having a first half 152 and a second half 154. The first half 152 and the second half 154 couple to one another to form the locking clamp 54 having the outer radial surface 120. As discussed above, the outer radial surface 120 of the locking clamp 54 has a geometry (e.g., hexagonal geometry) that corresponds to the geometry of the inner radial surface 118 of the locking clamp recess 110 in the rotary table adapter 52. As used herein, the term "correspond" refers to the matching or complimentary geometries of components that enable one component to fit securely and/or snuggly within another component to enable restriction of movement (e.g., lateral and/or rotational movement) of the components relative to one another when the components are assembled or fit within one another. For example, the geometries of the outer radial surface 120 of the locking clamp 54 and the inner radial surface 118 of the locking clamp recess 110 correspond with one another because the locking clamp 54 fits securely and/or snuggly within the locking clamp recess 110 to restrict lateral and rotational movement of the locking clamp 54 and the locking clamp recess 110 relative to one another. When the locking clamp 54 is clamped or coupled to the mandrel 46, the first and second halves 152 and 154 may be disposed on opposite sides of the mandrel 46 and may then be coupled to one another with the mandrel 46 disposed in a central aperture 156 of the clamp body 150.

In the illustrated embodiment, the first and second halves 152 and 154 are coupled to one another via bolts 158 (e.g., socket head bolts). For example, four bolts 158 may extend through respective apertures 160 formed in the first half 152 and threadingly engage with respective apertures 162 of the second half 154. Similarly, four bolts 158 may extend through respective apertures 164 formed in the second half 154 and threadingly engage with respective apertures 166 of the first half 152. In certain embodiments, a locking washer 168 may be disposed about each of the bolts 158. The bolts 158 may be tightened to the first and second halves 152 and 154 of the clamp body 150 with a mechanical hand tool or other suitable device.

To enable a rotationally fixed connection between the locking clamp 54 and the mandrel 46, the locking clamp 54 includes dies 170. When the first and second halves 152 and 154 of the locking clamp 54 are disposed on opposite sides of the mandrel 46 and are coupled to one another, each of the dies 170 "bites" into the outer surface of the mandrel 46. In this manner, the locking clamp 54 grips the mandrel 46 and creates the rotationally fixed connection between the locking clamp 54 and the mandrel 46. Each die 170 is disposed in a respective recess 172 formed in an inner radial surface 174 of the clamp body 150. The dies 170 and recesses 172 each have a tapered geometry that enables radial retention of the dies 170 within the respective recesses 172. In certain embodiments, the dies 170 may be standard, commercially-available dies (e.g., off-the-shelf dies), similar to those used in a mechanical tong. The dies 170 are axially retained within the recesses 172 via retention plates 176 disposed on opposite axial ends 178 of the clamp body 150. As shown in the illustrated embodiment, the retention plates 176 may be held in place by bolts 180 (e.g., flush mounted bolts). While the illustrated embodiment of the locking clamp 54 includes four dies 170 (i.e., two dies 170 in each of the first and second halves 152 and 154), other embodiments may include any suitable number of dies (e.g., 2, 3, 5, 6, 7, 8, or more). Additionally, the dies 170 may be spaced equidistantly about a circumference of the clamp body 150 or the dies 170 may be spaced at varying distances about the clamp body 150.

As mentioned above, different locking clamps 54 may be used for differently sized mandrels 46, each of which may be used with the universal actuator 48 and the grappling system 42. For example, one locking clamp 54 for one sized mandrel 46 may have an inner diameter 182 having a first size. For another locking clamp 54 to be used with a different sized mandrel 46, the inner diameter 182 may have a different size (e.g., smaller or larger). However, the different clamps 54 may each have a similar outer diameter 184. In this way, the different locking clamps 54 may be used with the same rotary table adapter 52. Other embodiments of the threaded connection breakout system 50 may include locking clamps 54 having different outer diameters 184 and may therefore use different rotary table adapters 52 having differently sized locking clamp recesses 110.

Figure 4:
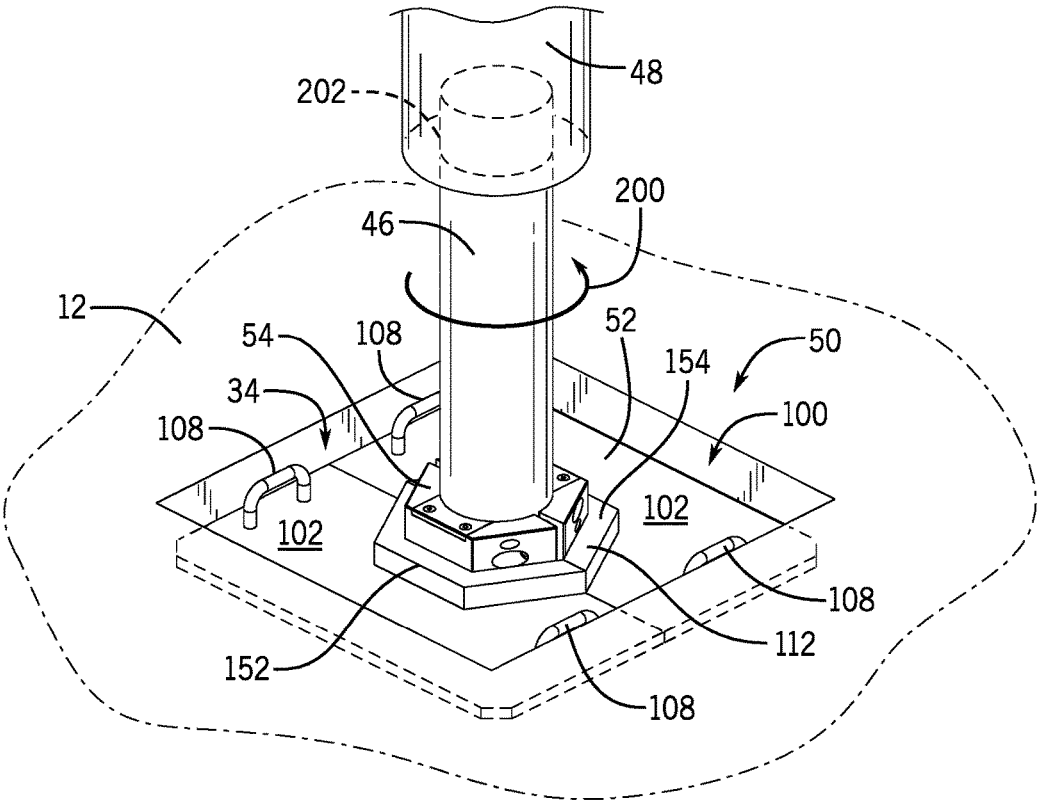
FIG. 4 is a perspective view of the threaded connection breakout system in a clamped and assembled configuration, in accordance with an embodiment of the present disclosure.

FIG. 4 is a perspective view of the threaded connection breakout system 50 in a clamped and assembled configuration. That is, the locking clamp 54 is clamped to and engaged with the mandrel 46 (i.e., the dies 170 "bite" into the mandrel 46), the locking clamp 54 is disposed within the locking clamp recess 110 of the rotary table adapter 52, and the rotary table adapter 52 is disposed within the recess 100 of the rotary table 32. As a result, the rotary table adapter 52, the locking clamp 54, and the mandrel 46 are rotationally fixed to one another. Therefore, the actuator 48 may be rotated, as indicated by arrow 200, via the top drive 40, a mechanical tong, or other manner, to make up or break a threaded connection 202 between the mandrel 46 and the actuator 48.

While the disclosed embodiments of the threaded connection breakout system 50 have been described in the context of making and/or breaking a threaded connection between the mandrel 46 and the actuator 48 of the grappling system 42, the disclosed embodiments may also be used to make or break threaded connections between any tubular members used with the drilling rig 10. For example, the threaded connection breakout system 50 may be used to make or break threaded connections between other actuators, saver subs, drill pipe, casing, tubing, or other tubular members. As will be appreciated, the inner diameter 182 of the locking clamp 54 may be sized or dimensioned such that the locking clamp 54 may be used with any tubular to be threaded or unthreaded from another tubular member.

As discussed above, the threaded connection breakout system 50 utilizes the rotary table 32 on the drilling rig floor 12 to transmit and/or react torque and allow for breakout (or makeup) of a threaded connection (e.g., threaded connection 202). The threaded connection breakout system 50 includes the rotary table adapter 52 and the locking clamp 54 configured to grip the mandrel 46 (or other tubular member) to be connected or disconnected with the actuator 48 (or other tubular member) via a threaded connection. The rotary table adapter 52 engages with the rotary table 32 on the drilling rig floor 12. When the locking clamp 54 is in gripping engagement with the mandrel 46, the locking clamp 54 is then engaged with the extension 112 of the rotary table adapter 52. Thereafter, torque may be applied to the mandrel 46 (e.g., via a mechanical tong or via the actuator 48 threaded to the mandrel 46), the torque may be transferred to the locking clamp 54, and the torque will react with the rotary table adapter 52 and the rotary table 32. In other words, the threaded connection breakout system 50 may hold the mandrel 46 in place, while the actuator 48 may be rotated to makeup or break the threaded connection 202 between the mandrel 46 and the actuator 48. In this manner, the threaded connection 202 between the mandrel 46 and the actuator 48 may be made or broken at a drilling site instead of at a machine shop or other remote location.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. A mineral extraction system, comprising:

a locking clamp configured to be secured to a first tubular member, wherein the locking clamp comprises an outer radial surface having a first geometry; and a rotary table adapter, comprising:

a base; and an extension extending from the base, wherein the extension defines a recess, the recess comprises an inner radial surface having a second geometry, wherein the first geometry and the second geometry correspond with one another, wherein the first geometry and the second geometry each comprises a generally hexagonal geometry, wherein the locking clamp is configured to be engaged with the rotary table adapter after the locking clamp is secured to the first tubular member, and wherein the rotary table adapter is configured to be disposed within a rotary table recess of a drilling rig.

2. The mineral extraction system of claim 1, wherein the locking clamp comprises a first half and a second half, wherein the first half and the second half are configured to be disposed opposite one another about the first tubular member, and the first half and the second half are configured to couple to one another about the first tubular member.

3. The mineral extraction system of claim 2, wherein the first half and the second half each comprises a plurality of recesses formed in a respective inner radial surface of the first half and the second half, wherein each recess of the plurality of recesses extends from an axial top to an axial bottom of the locking clamp.

4. The mineral extraction system of claim 3, comprising a plurality of dies, wherein each die of the plurality of dies is disposed within one of the recesses of the plurality of recesses.

5. The mineral extraction system of claim 4, wherein the locking clamp comprises a plurality of retaining plates, wherein each retaining plate of the plurality of retaining plates is secured to the axial top or the axial bottom of the locking clamp to axially retain at least one die of the plurality of dies within its respective recess.

6. The mineral extraction system of claim 4, wherein each die of the plurality of dies and each recess of the plurality of recesses comprises a tapered configuration.

7. The mineral extraction system of claim 2, wherein the first half and the second half of the locking clamp are configured to be coupled to one another via a plurality of bolts.

8. The mineral extraction system of claim 1, wherein the rotary table adapter comprises a first section and a second section, wherein the first section comprises a first portion of the extension, the second section comprises a second portion of the extension, and the first and second portions of the extension cooperatively define the inner radial surface having the second geometry.

9. The mineral extraction system of claim 8, wherein the first section and the second section each comprises at least one handle extending from the base of the rotary table adapter.

10. A method, comprising:

coupling a locking clamp to a first tubular of a drilling system, wherein the locking clamp and the first tubular are rotationally fixed relative to one another;

after coupling the locking clamp to the first tubular, positioning the locking clamp within a locking clamp recess defined by an extension of a rotary table adapter, wherein the recess comprises a first geometry corresponding to a second geometry of the locking clamp;

disposing the rotary table adapter within a rotary table adapter recess formed in a drilling rig floor; and rotating a second tubular relative to the first tubular to thread or unthread the first tubular to or from the second tubular.

11. The method of claim 10, wherein rotating the second tubular relative to the first tubular to thread or unthread the first tubular to or from the second tubular comprises rotating the second tubular with a top drive or with a mechanical tong.

12. The method of claim 10, wherein the first tubular comprises a mandrel of a tubular grappling system, and the second tubular comprises an actuator of a tubular grappling system.

13. The method of claim 10, wherein the first geometry and the second geometry each comprises a generally hexagonal shape.

14. The method of claim 10, comprising reacting torque applied to the first tubular by the second tubular with the drilling rig floor through the locking clamp and the rotary table adapter.

15. The method of claim 10, wherein coupling the locking clamp to the first tubular of the drilling system comprises:

disposing a first half of the locking clamp on a first side of the first tubular;

disposing a second half of the locking clamp on a second side of the first tubular opposite the first side;

securing the first half of the locking clamp to the second half of the locking clamp; and biting an outer surface of the first tubular with a plurality of dies disposed along an inner radial surface of the locking clamp.

16. A drilling system, comprising:

a mandrel of a tubular grappling system;

a universal actuator of the tubular grappling system configured to threadably engage with the mandrel;

a locking clamp secured to the mandrel, wherein the locking clamp comprises an outer radial surface having a first geometry;

a rotary table adapter comprising a locking clamp recess adapted to receive the locking clamp as the mandrel translates relative to the rotary table adapter, wherein the locking clamp recess comprises an inner radial surface having a second geometry, and the rotary table adapter defines a third geometry; and a drilling rig floor comprising a rotary table adapter recess defining a fourth geometry, wherein the first geometry and the second geometry correspond with one another, and the third geometry and the fourth geometry correspond with one another.

17. The drilling system of claim 16, wherein the first geometry and the second geometry each comprise a hexagonal shape, and the third geometry and the fourth geometry each comprise a quadrilateral shape.

18. The drilling system of claim 16, wherein the locking clamp recess is defined by an extension extending from a base of the rotary table adapter.

* * * * *